United States Patent [19]

Nayar et al.

[11] Patent Number: 4,623,476

[45] **Date of Patent: * Nov. 18, 1986**

[54] STABLE SUSPENSION OF PIGMENTS IN AQUEOUS HYPOCHLORITE BLEACH COMPOSITIONS

[75] Inventors: Bala C. Nayar; Kathleen G. Baier; David A. O'Brien, all of Cincinnati; Edward M. Sawicki, Norwood, all of Ohio

[73] Assignee: The Procter & Gamble Company, Cincinnati, Ohio

[ * ] Notice: The portion of the term of this patent subsequent to Jul. 2, 2002 has been disclaimed.

[21] Appl. No.: 751,766

[22] Filed: Jul. 2, 1985

Related U.S. Application Data

[63] Continuation-in-part of Ser. No. 595,171, Mar. 30, 1984, abandoned.

[51] Int. Cl.[4] ..... C11D 3/395; C11D 3/42

[52] U.S. Cl. ..... 252/94; 252/95; 252/99; 252/158; 252/160; 252/173; 252/174.25; 252/187.26; 252/539; 252/543; 252/DIG. 14

[58] Field of Search ..... 252/543, 94, DIG. 14, 252/95, 173, 102, 103, 104, 158, 174.25, 160, 187.26

[56] References Cited

U.S. PATENT DOCUMENTS

| | | | |
|---|---|---|---|
| 4,235,732 | 11/1980 | Beyer | 252/103 |
| 4,271,030 | 6/1981 | Brierley et al. | 252/98 |
| 4,526,700 | 7/1985 | Hensley et al. | 252/102 |
| 4,554,091 | 11/1985 | Jones et al. | 252/187.25 |

FOREIGN PATENT DOCUMENTS 2100307A 12/1982 United Kingdom .

*Primary Examiner*—Paul Lieberman
*Assistant Examiner*—Hoa Van Le
*Attorney, Agent, or Firm*—Leonard Williamson; Ronald L. Hemingway; Richard C. Witte

[57] ABSTRACT

Aqueous hypochlorite laundry bleach compositions containing a suspension of a bleach stable (e.g., Ultramarine Blue) pigment, optical brightener 4,4'-bis(4-phenyl-2H-1,2,3-triazol-2-yl)-2,2'-stilbenedisulfonate, and a certain alkylaryl sulfonate surfactant. Preferred compositions contain a bleach stable organic material having a density of from 0.8 to 1.05 g/cc, which organic material is preferably a perfume, and a bleach stable buffering agent to maintain pH and physical stability.

21 Claims, No Drawings

STABLE SUSPENSION OF PIGMENTS IN AQUEOUS HYPOCHLORITE BLEACH COMPOSITIONS

CROSS-REFERENCE TO RELATED APPLICATION

This is a continuation-in-part of U.S. application Ser. No. 595,171, filed Mar. 30, 1984, now abandoned.

FIELD OF THE INVENTION

The invention pertains to an aqueous hypochlorite laundry bleach product which contains suspended pigments, and to the process for making same.

BACKGROUND ART

"The conventional method of transferring optical brighteners or bluing agents to fabric is by adding the optical brighteners or bluing agents to the wash water along with the detergent. Generally, optical brighteners and bluing agents are not present in bleach, particularly liquid bleach, since the liquid bleach has a strong tendency to oxidize and destroy the dyes with concurrent reduction in bleaching strength. Alternative approaches involving addition of bleach stable inorganic pigments to liquid hypochlorite bleach to effect bluing have also been unsuccessful generally because the pigment particles have a tendency to settle out of suspension." Quoted from GB No. 2,100,307A, Dec. 22, 1982 (The Clorox Co.)

U.S. Pat. No. 4,271,030, Brierley et al., issued June 2, 1981, discloses a colored liquid hypochlorite bleach composition primarily designed for cleaning lavatory pans. The composition contains Ultramarine Blue (UMB) suspended in a flocculate, which is preferably made by reacting a soap or synthetic surfactant with calcium ions. Such a composition which contains a calcium floc is undesirable for laundry cleaning because the calcium floc will deposit on the fabric. (Also, a linear alkylbenzene sulfonate (LAS)/hypochlorite floc alone will not support an effective amount of Ultramarine Blue pigment at an LAS level desirable for an aqueous laundry bleach composition.) This '030 patent does not teach the essential optical brightener used in the present invention. It should also be noted that Ultramarine Blue pigment is distinguished from that essential optical brightener both chemically and physically and is not interchangeable.

U.S. Pat. No. 4,526,700, Hensley & Kitko, issued July 2, 1985, teaches the essential optical brightener technology to maintain physical stability in a nonpigmented system, but does not teach the buffer technology used to improve physical stability of flocculated bleach systems presented by this invention.

It is an object of the present invention to prepare a superior aqueous hypochlorite laundry bleach with suspended inorganic pigments, without calcium soap or the like.

SUMMARY OF THE INVENTION

The present invention is directed to the formulation of aqueous sodium hypochlorite laundry bleach compositions containing a dispersion of bleach stable inorganic pigment, an optical brightener and LAS (linear alkylbenzene sulfonate). The preferred compositions comprise a uniform mixture of from about 3% to about 10% sodium hypochlorite, from 0.01% to 0.3% of the Ultramarine Blue pigment, from about 0.025% to about 0.2% of the optical brightener, 4,4'-bis(4-phenyl-2H-1,2,3-triazol-2-yl)-2,2'-stilbenedisulfonate, from about 0.05% to about 2% of a certain alkylaryl sulfonate surfactants, and preferably from 0.2% to 10% of soluble bleach stable buffers having pKa's between 9.5 and 13.5, and preferably from about 0.01% to about 0.5% of a bleach stable organic oil, and at least 80% water.

DETAILED DESCRIPTION OF THE INVENTION

In accordance with the present invention it has been found that the bleach stable pigment selected from the group consisting of chlorinated indanthrone (and its equivalents) and Ultramarine Blue, $Na_7Al_6Si_6O_{24}S_2$ (and its equivalents), can be stably dispensed in an aqueous sodium hypochlorite laundry bleach containing LAS and a special optical brightener. The pigment can be mixed with the LAS/optical brightener before they are salted out as a fine dispersion or it can be mixed into the LAS/optical brightener/hypochlorite. The blue pigment particles settle very slowly. When settling does occur, the settled layer of particles is very loose and occupies a substantial volume of the composition. The settled particles can be readily redispersed throughout the composition by gentle shaking of the bottle or other container from which the composition is to be dispensed. If an organic oil such as perfume is included in the formulation, the blue composition is very stable and very little settling occurs.

In addition to pigments, it has been found that the inclusion of bleach stable buffers improves the physical stability with time in pigmented and nonpigmented compositions. Buffers that result in improved stability have pKa's between 9.5 and 13.5, preferably between 10.5 and 13.0. Examples of buffers meeting this criteria include sodium or potassium orthophosphate, sodium or potassium carbonate, sodium or potassium silicates, or derivatives thereof.

All percentages herein are "by weight" unless specified otherwise.

Some preferred compositions of the invention comprise:

(a) from about 3% to about 10% sodium hypochlorite;

(b) from about 0.01% to about 0.3% (preferably 0.01% to 0.1%) of the pigment selected from the group consisting of Ultramarine Blue $Na_7Al_6Si_6O_{24}S_2$ and its equivalents, and chlorinated indanthrone (3,3'-dichloroindanthrone) and its equivalents;

(c) from about 0.025% to about 0.2% of an optical brightener selected from the group consisting of optical brightener 4,4'-bis(4-phenyl-2H-1,2,3-triazol-2-yl)-2,2'-stilbenedisulfonic acid or any one of its functional equivalent derivative salts, preferably its alkali metal or amine salts;

(d) from about 0.05% to about 2% of a surfactant selected from the group consisting of alkylaryl sulfonates having the formulas:

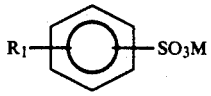

and

-continued

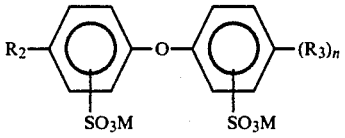

wherein $R_1$ is a $C_8$–$C_{20}$ alkyl group, $R_2$ and $R_3$ are $C_6$–$C_{16}$ alkyl groups, M is alkali metal and n is 0 or 1;

(e) preferably from about 0.2% to about 10% potassium or sodium orthophosphate, carbonate, silicates, or derivatives or mixtures thereof;

(f) preferably from about 0.01% to about 0.5% of a bleach stable organic oil; and, (g) at least about 80% water;

wherein the pigment is suspended in the composition in the form of dispersed particles.

The composition of this invention prepared by either admixing the pigments prior to or after mixing the brightener/surfactant solution with the aqueous sodium hypochlorite.

Sodium Hypochlorite

Typically, sodium hypochlorite is commercially available in aqueous solutions having a concentration of from about 5% to about 15%. These solutions typically contain an amount of sodium chloride about equal, (on a mole basis) to the amount of sodium hypochlorite. In making the compositions of the present invention it is generally desirable to add sodium hypochlorite solution to a pigment/brighener/surfactant solution in volumes such that the volume of sodium hypochlorite will be from about 0.4 to about 8 times the volume of the pigment/brightener/surfactant solution. Accordingly, the aqueous sodium hypochlorite source chosen from preparing a composition of the invention should be one which has a sodium hypochlorite concentration such that it can be mixed with the aqueous pigment/brightener/surfactant solution within these volume proportions to produce the desired amounts of sodium hypochlorite, pigment, brightener and surfactant in the finished product.

Sodium hypochlorite is present in the compositions of the invention at levels of from about 3% to about 10%, preferably from about 4% to about 6%.

Pigments

A preferred pigment used in this invention is Ultramarine Blue. It is sold as "C.I. Pigment Blue 29; C.I. 77007". It is a blue pigment occurring naturally as the mineral lapis lazuli. It is made by igniting a mixture of kaolin, $Na_2CO_3$ (or $Na_2SO_4$), S and carbon. The resulting product is believed to have the formula $Na_7Al_6Si_6O_{24}S_2$. It is insoluble in water and readily decomposed by acids, even carbonic acid, with liberation of $H_2S$.

"It is used as a pigment in calico printing, wallpaper, mottled soap; bluing in laundry use; for coloring tiles, cement, rubber, but is now largely replaced by coal tar dyes." *The Merck Index,* 9th Ed. Ultramarine Blue is available from Whittaker, Clark & Daniels, Inc. Grade 5017 has a particle size range of 0.2–3.0 microns and Grade 5151 has a particle size range of 0.3–1.3 microns.

Another preferred pigment is C.I. 69825 and is known under the names of C.I. Vat Blue 6 and C.I. Pigment Blue 64. They have the following chemical formula.

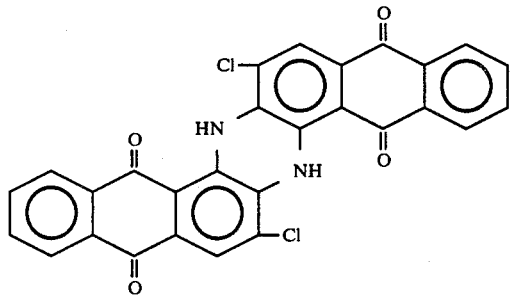

This C.I. 69825 pigment is available from Crompton & Knowles Corporation under the name Intravat Blue.

The pigment is present in the composition of this invention at levels of from about 0.01% to about 0.3%, preferably from about 0.02% to about 0.05% and more broadly 0.01% to 0.1%.

Brightener

The brightener used in the compositions herein is 4,4'-bis(4-phenyl-2H-1,2,3-triazol-2-yl)-2,2'-stilbenedisulfonic acid, or one of its functionally equivalent derivative salts, preferably its amine and alkali metal (e.g., sodium or potassium) salts, or mixtures thereof. The structure of the sodium salt is:

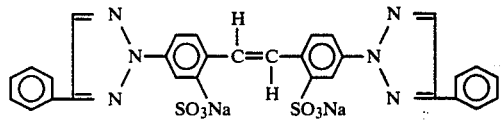

This optical brightener is available from Mobay Chemical Corporation, a subsidiary of Bayer AG, under the name Phorwite® CNA. Also the amine salt is available from Mobay under the trade name Phorwite CL Solution. The potassium salt is available under the trade name of Phorwite BHC 766.

The optical brightener is present in the compositions of the invention at levels of from about 0.025% to about 0.2%, preferably from about 0.05% to about 0.075%.

Surfactant

The surfactants used in the present invention are alkylaryl sulfonates of the following formulas:

1.

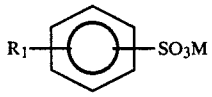

2.

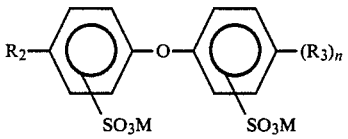

wherein $R_1$ is an alkyl group of from 8 to 20 (preferably 11 to 13) carbon atoms, $R_2$ and $R_3$ are alkyl groups of 6 to 16 (preferably 10–12) carbon atoms and M is an alkali metal, e.g., sodium or potassium, and n is 0 or 1.

Surfactants of Formula 1 are called alkylbenzene sulfonates and are available under various tradenames, e.g., Calsoft® L-60, F-90 and L-40 from Pilot Chemical Company, and Naccanol® 35SL and 90F from Stephan Chemical Company.

Surfactants of Formula 2 are alkyl diphenyloxide sulfonates and are available under the Dowfax® name from Dow Chemical Company.

The surfactants are present in the compositions herein at levels of from about 0.05% to about 2.0%, preferably from about 0.2% to about 1.0%. In aqueous laundry bleach products a most preferred range is from 0.2% to about 0.5%.

The presence of surfactant in the compositions of the invention has been found to be essential to creating dispersed particles of brightener having a small particle size. If surfactant is not used, the particles are much larger. These larger particles have the appearance of curd and render the product less appealing from an aesthetic standpoint. The UMB pigment will settle quickly if only surfactant or only brightener is used. The surfactant/brightener dispersion must be present for a uniform UMB bleach in the practice of this invention.

Organic Oils

Preferred compositions contain an organic oil which has a density of from 0.8 to 1.05. Preferably, the oils are present in the compositions of the invention at levels of from 0.01% to about 0.5%, preferably from about 0.05% to about 0.3%. Preferred oils are perfume materials which have a relatively high degree of stability to sodium hypochlorite. Some preferred materials for use as perfume ingredients in the compositions herein are patchouli oil, cyclopentadecanolide, p-tertiarybutyl cyclohexyl acetate, tetrahydromycenol, tetrahydrolinalool, phenylacetaldehyde dimethylacetal, methylphenyl carbinol, and mixtures thereof. Aromatic solids commonly used in the perfume, which are also hpochlorite stable can be dissolved into the organic oil. Some examples are 1,3,5-trinitro-2-tertiary butylxylene and 1,3,5-pentamethyl-4,6-dinitroindane. Another preferred organic oil is linear alkyl benzene (LAB) having alkyl chains of from 4 to 20 carbon atoms, preferably from 10 to 14 carbon atoms.

When organic oils are used in the compositions herein they are mixed into the pigment, brightener, or surfactant solution prior to the addition of aqueous sodium hypochlorite to the solution.

Some preferred bleach stable organic oils are selected from the group consisting of:

(A) $C_6$–$C_{20}$ aliphatic tertiary alcohols having the following molecular structures:

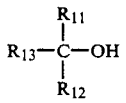

wherein $R_{11}$ is a $C_3$–$C_{17}$ straight chain, branched or cyclic saturated alkyl group and $R_{12}$ and $R_{13}$ are $C_1$–$C_{12}$ straight chain or branched saturated alkyl groups;

(B) $C_6$–$C_{20}$ aliphatic esters having the following molecular structures:

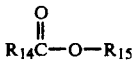

wherein $R_{14}$ is a $C_1$–$C_{18}$ straight chain, branched or cyclic saturated alkyl group and $R_{15}$ is a $C_1$–$C_{18}$ straight chain, branched or cyclic saturated alkyl group;

(C) $C_6$–$C_{20}$ aromatic esters and diesters having the following molecular structures:

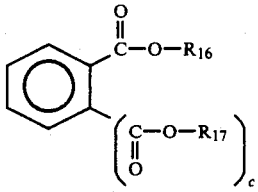

wherein $R_{16}$ and $R_{17}$ are $C_1$–$C_{12}$ straight chain, branched, or cyclic saturated alkyl groups, and c is 0 or 1;

(D) $C_6$–$C_{20}$ lactones having the structure:

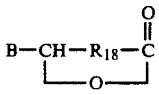

wherein $R_{18}$ is a $C_1$–$C_{16}$ straight chain or branched saturated alkyl group; and B is a hydrogen atom or $C_1$–$C_{16}$ straight chain or branched saturated alkyl group;

(E) $C_6$–$C_{20}$ acetals and $C_6$–$C_{20}$ ketals having the following molecular structures:

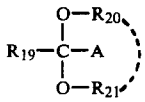

wherein $R_{19}$ is a $C_3$–$C_{16}$ straight chain, branched or cyclic saturated alkyl group or is a benzyl, alkylbenzyl, dialkylbenzyl, 2-phenylethyl, or naphthyl group; and $R_{20}$ and $R_{21}$ are separate $C_1$–$C_{12}$ straight chain or branched saturated alkyl chains or together complete a five membered ring by contributing two saturated carbon atoms and may or may not contain an alkyl substituent, and A is a hydrogen atom or a $C_1$–$C_8$ straight chain or branched saturated alkyl group;

(F) and mixtures thereof.

A preferred embodiment of the present invention is where some or all of the organic oil materials are also perfume ingredients. For example, the following organic oil materials can also be used as perfume ingredients:

TABLE A 2,6-dimethyloctan-2-ol,
3,7-dimethyloctan-3-ol,
2,6-dimethylheptan-2-ol,
2,4,4-trimethylpentan-2-ol,
2,4,4,6,6-pentamethylheptan-2-ol,
1-methyl-4-isopropylcyclohexan-8-ol,
4-tertiarybutylcyclohexyl acetate,
4-tertiarypentylcyclohexyl acetate,
diethylphthalate, phenylacetaldehyde dimethyl acetal, and mixtures thereof.

If organic oil usage is toward the upper end of the usage range (i.e., 0.3% to 0.5%) then it is usually necessary to use an amount of surfactant which is also at the higher end of the 0.05% to 2% surfactant usage range hereinbefore disclosed.

Buffering Agents

From about 0.2% to about 10% by weight, preferably from about 1% to 5% by weight, of the present compositions comprises an inorganic buffering agent capable of maintaining composition pH within the range of from about 10.5 to 13.5; preferably from about 11 to 13. Maintenance of composition pH within this relatively high range is essential to the preservation of the unique chemical and physical stability of the liquid bleach product.

It has been discovered that maintenance of the composition pH within the 10.5 to 13.5 range minimizes the undesirable chemical decomposition of the active chlorine, hypochlorite-yielding bleaching agents, said decomposition generally being encountered when such bleaching agents are admixed with organic components in unbuffered aqueous solution. Maintenance of this essential pH range also minimizes the chemical interaction between the strong hypochlorite bleach and the surfactant compounds essentially present in the instant compositions. Additionally, the inclusion of buffers improves the physical stability of these bleach/optical brightener systems versus those taught by U.S. Pat. No. 4,526,700, supra.

Any bleach-stable material or mixture of materials which has a pKa of 9.5 to 13.5 will have the effect of altering composition pH to within the 10.5 to 13.5 range and maintaining it there can be utilized as the buffering agent in this invention. Such materials can include, for example, various water-soluble salts such as the carbonates, bicarbonates, sesquicarbonates, silicates, phosphates, tetraborates, and mixtures thereof. Examples of materials which can be used either alone or in combination as the buffering agent herein include sodium carbonate, sodium bicarbonate, sodium sesquicarbonate, sodium silicates, sodium orthophosphate and sodium tetraborate. Preferred buffering agents for use herein include sodium orthophosphate, sodium carbonate, sodium silicates, or mixtures thereof. Other suitable anions can also be used.

Composition Preparation

The compositions of the invention are preferably prepared by the following steps:

1. Preparing an aqueous solution containing from about 0.01% to about 0.3% UMB pigment, from about 0.05% to about 0.4% of the brightener; from about 0.1% to about 4% of the surfactant; and from 0% to about 1.0% bleach stable perfume or organic oil. The pigment is added last. Alternatively, the pigment is added at the end of or during Step 2.

2. Adding slowly, and with low shear mixing, to the solution of Step 1, a sufficient amount of aqueous sodium hypochlorite to produce a final composition comprising from about 3% to about 10% sodium hypochlorite, from about 0.01% to about 0.3% UMB pigment, from about 0.025% to about 0.2% brightener; from about 0.05% to about 2% surfactant; from about 0.2% to about 10% buffers, and from 0% to about 0.5% perfume or oil.

3. Adding slowly, with low shear mixing, to the solution of Step 2, a sufficient amount of buffering agents to adequately stabilize the product. The buffer can be added dry or as an aqueous solution or slurry to deliver the levels desired in the final composition.

The aqueous solution of Step 1 is preferably prepared with deionized water. This minimizes the presence of heavy metal ions, which tend to cause decomposition of sodium hypochlorite. At the higher end of the brightener concentration ranges, heating of the solution may be necessary to get all of the brightener into solution. The organic oil (if used) is added after the surfactant has been added. Higher levels of oil generally require surfactant usage to be at the high end of the above stated concentration range.

When adding concentrated sodium hypochlorite to the aqueous composition of Step 1 the hypochlorite should be added slowly and with gentle mixing. The rate of addition should be sufficiently slow to allow maintenance of substantial uniformity of hypochlorite throughout the system, notwithstanding the gentle mixing. As the hypochlorite is added, brightener and surfactant will be salted out as a fine dispersion. Mixing should be gentle throughout the addition of the hypochlorite. High shear mixing and other forms of mixing which produce a high degree of agitation should be avoided since they will lead to formation of larger particles which have poor suspension properties in the solution. The dispersion is best described as loose aggregates of very small brightener and surfactant particles. The insoluble UMB is uniformly dispersed in the system and thereby provides uniform color.

In the compositions made in accordance with this invention, the particles of pigment/brightener/surfactant will typically remain more or less homogeneously suspended in the compositions for at least fifteen minutes, and in most cases an hour or more. The length of time depends on the amount of pigment present. A smaller amount can remain suspended for days. Even after the composition eventually becomes nonhomogeneous, most of the particles do not settle to the bottom of the composition, but remain suspended in the bottom one quarter to three quarters of the composition volume. With a very minor amount of agitation (such as by inverting a bottle and returning it to its upright position) a homogeneous composition is quickly restored. When an organic oil is used the pigment is stably suspended for days. When a buffering agent is present, the volume the precipitate occupies after 10 days is substantially more than if buffering agents were not present. Thus, the present invention provides compositions whereby consistent dosages of a combination of sodium hypochlorite, pigment, buffers and optical brightener in a concentrated aqueous medium can be easily obtained.

For best chemical stability, the compositions herein should have a pH of 11 to 13. The pH of the composition should be tested after preparation is complete. If needed, pH adjustment can be made with acid or base (e.g., HCl, $H_2SO_4$ or NaOH). The inclusion of buffers helps to maintain chemical stability, especially at a lower pH.

The invention will be illustrated by the following examples.

EXAMPLE I

A composition consisting of:

| Ingredient | | Wt. % |
|---|---|---|
| Ultramarine Blue | | 0.02 |
| Brightener | | 0.05 |
| Surfactant (NaLAS) | | 0.25 |
| Perfume* | | 0.15 |
| NaOCl (~13%) | | 44.25 |
| Water | to | 100.00 |

1600 g of the sample were made. 0.80 g of brightener (Phorwite CNA ®, Mobay Chemical Corp.) was taken in 530 ml hot (~65° C.) water in a 1-liter flask. The mixture was stirred moderately with a magnetic stirrer-cum-hot plate. 4.44 g of NaLAS surfactant (Calsoft F-90, 90% active having an average alkyl chain of 12 carbon atoms, Pilot Chemical Co.) were added and the brightener completely went into solution. The mixture was transferred into a 2-liter beaker with baffles and 354 ml cold water were added. The mixture (~40° C.) was then stirred by an electrical stirrer at ~400 rpm. A bleach stable organic oil perfume (2.4 g) and then Ultramarine Blue (0.32 g, grade 5017, Whittaker, Clark & Daniels, Inc.) were added and the mixture was stirred for 30 minutes. 708 g of bleach solution (~13% NaOCl content) were gradually added to the brightener/surfactant/perfume/pigment mixture over a 20 minute period. The brightener and surfactant were salted out and were dispersed uniformly throughout the vessel. 500 ml of this bleach composition were taken in a graduated 500 ml glass cylinder for settling studies. The pH of the final composition was determined to be 12.57 at 24° C. After 7 days of storage at ambient conditions, there was only 2% settling. The pigment was uniformly dispersed in 98% of the composition volume providing a uniform coloration.

EXAMPLE II

Same as Example I, except that the pigment was added to the system after the hypochlorite was added to the perfume/brightener/surfactant solution. A homogeneous blue product was formed which also remained stable for several days.

EXAMPLE III

A composition consisting of:

| Ingredient | | Wt. % |
|---|---|---|
| Ultramarine Blue Pigment | | 0.02 |
| Surfactant (NaLAS) | | 0.25 |
| NaOCl (~13%) | | 44.25 |
| Water | to | 100.00 |

The procedure for making the composition of Example III was the same as that of Example I, except that in Example III the brightener and perfume were not included. The surfactant was precipitated by addition of the bleach solution. The pigment was gently stirred into the surfactant precipitate. The pigment settled down entirely to the bottom 5% of the cylinder within about 3 hours.

This example shows that it is not possible to get a stable suspension of the pigment in a bleach composition by surfactant alone.

The purpose of Example IV is to show that a calcium floc will not support Ultramarine Blue even if used at a level of several times that of the brightenr of this invention. This calcium floc is similar to the floc compositions disclosed in U.S. Pat. No. 4,271,030, Brierley et al., issued June 2, 1981.

EXAMPLE IV

Compositions were made consisting of:

| | | Wt. % | | |
|---|---|---|---|---|
| Ingredient | | Comp. A | | Comp. B |
| Ultramarine Blue | | 0.03 | | 0.05 |
| $CaCl_2$ | | 0.275 | | 0.275 |
| Surfactant (NaLAS) | | 0.25 | | 0.25 |
| NaOCl (~13%) | | 44.25 | | 44.25 |
| Water | to | 100.00 | to | 100.00 |

The procedure was to dissolve the surfactant in water first and then add an 11% solution of calcium chloride slowly and with gentle stirring. Bleach was added next, again slowly and with gentle stirring. A 10% dispersion of UMB in water was then added and stirred to distribute the pigment uniformly in the composition. 500 ml of Compositions A and B were stored in 500 ml graduated glass cylinders. Within an hour, almost the entire pigment had settled down, in both cases.

EXAMPLE V

Compositions were made consisting of:

| | | Wt. % | | |
|---|---|---|---|---|
| Ingredient | | Comp. A | | Comp. B |
| Ultramarine Blue Pigment | | 0.03 | | 0.05 |
| Brightener | | 0.05 | | 0.05 |
| Surfactant (NaLAS) | | 0.25 | | 0.25 |
| NaOCl (~13%) | | 44.25 | | 44.25 |
| Water | to | 100.00 | to | 100.00 |

The procedure was the same as described in Example I, except that in Example V the UMB was added as a 10% dispersion in water after the brightener/surfactant dispersion was formed by the addition of NaOCl. 500 ml of Compositions A and B were stored in 500 ml graduated glass cylinders. The pigment was substantially stable for several days.

EXAMPLE VI

A composition consisting of:

| Ingredient | | Wt. % |
|---|---|---|
| Intravat Blue GF Paste | | 0.02 to 0.1 |
| Brightener | | 0.05 |
| Surfactant (NaLAS) | | 0.25 |
| Perfume | | 0.15 |
| NaOCl (~13%) | | 44.25 |
| Water | to | 100.00 |

The pigment was added after precipitation of the brightener and surfactant. Pigment levels were varied from 0.02% to 0.1% to get different shades of blue color. In all cases, the pigment was dispersed uniformly throughout the composition and had excellent physical stability for several days. There was also good chemical stability as evidenced by the retention of color and % NaOCl.

Alternatively, it is possible to mix the pigment in the brightener/surfactant mixture before the bleach is added.

EXAMPLE VII

A composition consisting of:

| Ingredient | | Wt. % |
|---|---|---|
| Ultramarine Blue Pigment | | 0.05 |
| Brightener | | 0.05 |
| Surfactant (NaLAS) | | 0.25 |
| Linear $C_{12}$ Alkyl Benzene | | 0.15 |
| NaOCl (~13%) | | 44.25 |
| Water | to | 100.00 |

The pigment was dispersed uniformly throughout the composition and exhibited excellent phase stability even after setting for 28 days (i.e., the pigment filled at least 90% of the volume of a 500 ml graduated cylinder).

EXAMPLE VIII

A composition consisting of:

| Ingredient | Wt. % |
|---|---|
| Intravat Blue GF Paste | 0.04 |
| NaOCl (~5.25%) | 99.96 |

An intense blue color was obtained immediately after the pigment was mixed with NaOCl. However, the pigment settled down entirely overnight (~1% of volume). This example shows the pigment is not suspendible in hypochlorite solutions by itself.

EXAMPLE IX

A composition consisting of:

| Ingredient | | Wt. % |
|---|---|---|
| Intravat Blue GF Paste | | 0.06 |
| Surfactant (NaLAS) | | 0.25 |
| NaOCl (~13%) | | 44.25 |
| Water | to | 100.00 |

The surfactant was precipitated first by addition of the bleach. The pigment was then stirred into the surfactant/precipitate/bleach mixture. An intense blue coloration was obtained immediately after mixing with the pigment, but the pigment settled down entirely overnight. Example IX shows that it is not possible to get a stable suspension of the pigment in a bleach composition by surfactant alone without the presence of the optical brightener.

EXAMPLE X

Compositions consisting of:

| Composition A | | Composition B | |
|---|---|---|---|
| Ingredient | Wt % | Ingredient | Wt % |
| Brightener | 0.05 | Brightener | 0.05 |
| NaLAS | 0.25 | NaLAS | 0.25 |
| Perfume | 0.19 | Perfume | 0.19 |
| NaOCl (~13%) | 44.25 | NaOCl (~13%) | 44.25 |
| Water to | 100% | Sodium Orthophosphate, Tribasic | 1.50 |
| NaOH to pH | 12.2 | Water to | 100% |
| | | NaOH to pH | 12.2 |

The purpose of this example is to show that the physical and chemical characteristics are suprisingly improved by the inclusion of buffers to the formula (Table 1). This shows that a bleach product can be made with superior physical and chemical characteristics as presented in Hensley/Kitko, U.S. Pat. No. 4,526.700, supra.

TABLE 1

| | % AvCl Remaining | | Volume of Precipitate | |
|---|---|---|---|---|
| Time (Days at 120° F.) | A | B | A | B |
| 10 days | 4% | 60% | 1% | 24% |

Any settling in Composition B can easily be resuspended by gently tilting, whereas settling in Composition A cannot.

EXAMPLE XI

Compositions are made consisting of:

| Composition C | | Composition D | |
|---|---|---|---|
| Ingredient | Wt % | Ingredient | Wt % |
| Brightener | 0.05 | Brightener | 0.05 |
| NaLAS | 0.25 | NaLAS | 0.25 |
| Perfume | 0.19 | Perfume | 0.19 |
| NaOCl (~13%) | 44.25 | NaOCl (~13%) | 44.25 |
| Ultramarine Blue Pigment | 0.03 | Ultramarine Blue Pigment | 0.03 |
| Water to | 100% | Trisodium Phosphate | 1.50 |
| NaOH to pH | 12.2 | Water to | 100% |
| | | NaOH to pH | 12.2 |

Example XI shows that with Ultramarine Blue pigment physical and chemical stability are improved by buffers (Table 2).

TABLE 2

| | % AvCl Remaining | | Volume of Precipitate | |
|---|---|---|---|---|
| Time (Days at 120° F.) | C | D | C | D |
| 10 days | 6% | 59% | 1% | 28% |

Any settling in Composition D is easily resuspended by gently tilting, whereas settling in Composition C cannot.

What is claimed is:

1. An aqueous laundry composition comprising:

(a) from about 3% to about 10% sodium hypochlorite;

(b) from about 0.01% to about 0.3% of a bleach stable pigment selected from the group consisting of Ultramarine Blue, chlorinated indanthrone and their equivalents;

(c) from about 0.025% to about 0.2% of an optical brightener having the formula:

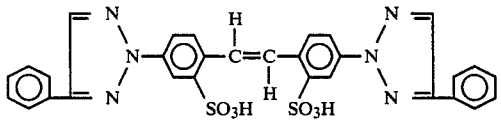

or the equivalent derivative salts thereof;

(d) from about 0.05% to about 2% of a surfactant selected from the group consisting of alkylaryl sulfonates having the formulas:

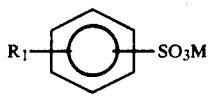

and

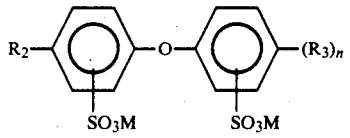

wherein $R_1$ is a $C_8$–$C_{20}$ alkyl group, $R_2$ and $R_3$ are $C_{10}$–$C_{16}$ alkyl groups, M is alkali metal and n is 0 or 1;

(e) from 0% to about 0.5% of a relatively bleach stable organic oil having a density of 0.8 to about 1.05 g/cc;

(f) from about 0% to about 10% of bleach stable buffering agent capable of maintaining the bleach pH between 10.5 and 13.5; and (g) at least about 80% water;

wherein the pigment is uniformly dispersed in an aqueous system of said brightener and said surfactant; and wherein the said compositions is made by a process comprising the steps of:

1. preparing an aqueous system containing said pigment, said optical brightener, said surfactant, and said bleach stable organic oil;
2. adding slowly, and with low shear mixing, to the system of Step 1, a sufficient amount of aqueous sodium hypochlorite to produce a final composition comprising from about 3% to about 10% sodium hypochlorite, from about 0.01% to about 0.3% of pigment, from about 0.025% to about 0.2% optical brightener, from about 0.05% to about 2% surfactant, and from 0% to about 0.5% of said bleach stable organic oil;
3. Adding the buffering agent at the desired level to produce the final composition.

2. The composition of claim 1 wherein said organic oil is added to the aqueous system of Step 1 after the surfactant and brightener have been mixed.

3. The composition of claim 1 wherein the amount of pigment in the finished composition is from 0.01% to about 0.1%.

4. The composition of claim 1 wherein the amount of sodium hypochlorite in the finished composition is from about 4% to about 6%.

5. The composition of claim 1 wherein the amount of optical brightener in the finished composition is from about 0.05% to about 0.075%.

6. The composition of claim 1 wherein the amount of surfactant in the finished composition is from about 0.2% to about 1%.

7. The composition of claim 1 wherein the amount of organic oil in the finished composition is from about 0.05% to about 0.3%.

8. The composition of claim 1 wherein the buffering agent is a salt of a carbonate, silicate, orthophosphate, or tetraborate, and is present at a level of 0.2% to 10%.

9. The composition of claim 1 or 8 wherein the amount of buffering agent is from about 1.5% to about 5%.

10. An aqueous laundry composition comprising:

(a) from about 3% to about 10% sodium hypochlorite;

(b) from about 0.1% to about 0.3% of a bleach stable pigment selected from the group consisting of Ultramarine Blue, chlorinated indanthrone and their equivalents;

(c) from about 0.025% to about 0.2% of an optical brightener having the formula:

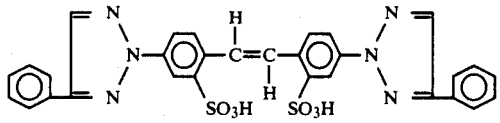

or the equivalent derivative salts thereof;

(d) from about 0.05% to about 2% of a surfactant selected from the group consisting of alkylaryl sulfonates having the formulas:

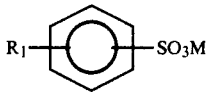

and

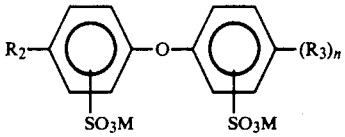

wherein $R_1$ is a $C_8$–$C_{20}$ alkyl group, $R_2$ and $R_3$ are $C_{10}$–$C_{16}$ alkyl groups, M is alkali metal and n is 0 or 1;

(e) from 0% to about 0.5% of a relatively bleach stable organic oil having a density of 0.8 to about 1.05;

(f) from about 0% to about 10% of a bleach stable buffering agent; and (g) at least about 80% water;

wherein the pigment is uniformly dispersed in an aqueous system of said brightener and said surfactant; and wherein the said compositions is made by a process comprising the steps of:

1. preparing an aqueous system containing said optical brightener, said surfactant, and said bleach stable organic oil;
2. adding slowly, and with low shear mixing, to the system of Step 1, a sufficient amount of aqueous sodium hypochlorite and a sufficient amount of said pigment to produce a final composition comprising from about 3% to about 10% sodium hypochlorite, from about 0.01% to about 0.3% of pigment, from about 0.025% to about 0.2% optical brightener, from about 0.05% to about 2% surfactant, and from 0% to about 0.5% of said bleach stable organic oil;
3. adding the buffering agent at the desired level to produce the final composition.

11. The composition of claim 10 wherein a sufficient amount of said organic oil is added to the aqueous system of Step 1 after the surfactant and brightener have been mixed to provide a final composition comprising at least about 0.01% said organic oil.

12. The composition of claim 1 wherein the amount of pigment in the finished composition is from 0.01% to about 0.1%.

13. The composition of claim 10 wherein the amount of sodium hypochlorite in the finished composition is from about 4% to about 6%.

14. The composition of claim 10 wherein the amount of optical brightener in the finished composition is from about 0.05% to about 0.075%.

15. The composition of claim 10 wherein the amount of surfactant in the finished composition is from about 0.2% to about 1%.

16. The composition of claim 10 wherein the amount of organic oil in the finished composition is from about 0.05% to about 0.3%.

17. The composition of claim 10 wherein the buffering agent is a salt of a carbonate, silicate, orthophosphate, or tetraborate, and is present at a level of 0.2% to 10%.

18. The composition of claim 10 or 17 wherein the amount of bleach stable buffering agent is between 1.5% and 5%.

19. The composition of claims 1, 10 and 16 wherein said organic oil includes a perfume.

20. The composition of claims 1, 10 and 16 wherein said organic oil includes a linear alkyl benzene with a preferred chain length of 10–14 carbon atoms.

21. The composition of claim 20 wherein said linear alkyl benzene has an average chain length of about 12 carbon atoms.

* * * * *

UNITED STATES PATENT AND TRADEMARK OFFICE

CERTIFICATE OF CORRECTION

PATENT NO. : 4,623,476

DATED : November 18, 1986

INVENTOR(S) : Bala C. Nayar, Kathleen G. Baier, David A. O'Brien and Edward M. Sawicki It is certified that error appears in the above-identified patent and that said Letters Patent are hereby corrected as shown below:

Col. 3 , line 37, "from" should read --- for ---.

Col. 9, line 10, asterisk explanation for "Perfume*" omitted. It should read as follows:

*The perfume has a density of about 1.03 g/cc and contains about 15% 2,6-dimethyloctan-2-ol, about 15% of 3,7-dimethyl-octan-3-ol and balance made of one or more components listed in Table A.

Signed and Sealed this

Sixteenth Day of February, 1988

*Attest:*

*Attesting Officer*

DONALD J. QUIGG

*Commissioner of Patents and Trademarks*